United States Patent [19]

Holzwarth et al.

[11] 3,963,172

[45] June 15, 1976

[54] WINDOWED MID-LOCK CARTON WITH POSITIVE CLOSURE LATCH

[75] Inventors: Henry A. Holzwarth, Bayside; John D. Wark, Freeport, both of N.Y.

[73] Assignee: Keyes Fibre Company, Waterville, Maine

[22] Filed: Mar. 24, 1975

[21] Appl. No.: 561,257

[52] U.S. Cl. ..... 229/44 EC; 206/45.34; 229/2.5 EC; 229/45 EC

[51] Int. Cl.[2] ..... B65D 1/36; B65D 43/16; B65D 85/32

[58] Field of Search ..... 229/2.5 EC, 44 EC, 45 R, 229/45 EC, 29 M; 206/45.31, 45.34; 220/339

[56] References Cited

UNITED STATES PATENTS

| | | | |
|---|---|---|---|
| 2,578,739 | 12/1951 | Randall | 229/29 M X |
| 2,591,471 | 4/1952 | Schwertfeger | 229/2.5 EC X |
| 3,282,462 | 11/1966 | Box | 220/339 X |
| 3,501,083 | 3/1970 | Lake | 229/2.5 EC X |
| 3,580,479 | 5/1971 | Weiss | 229/44 EC |
| 3,580,480 | 5/1971 | French | 229/44 EC X |
| 3,647,132 | 3/1972 | Crabtree | 229/44 EC X |

FOREIGN PATENTS OR APPLICATIONS

| | | | |
|---|---|---|---|
| 6,906,069 | 10/1969 | Netherlands | 229/2.5 EC |

*Primary Examiner*—William Price
*Assistant Examiner*—Stephen Marcus
*Attorney, Agent, or Firm*—Connolly and Hutz

[57] ABSTRACT

A one-piece molded egg carton of the type having a tray-like bottom section with two parallel rows of downwardly dished egg receiving pockets, two articulated trough-shaped cover sections integrally hinged to the opposite sides of the bottom section for closing up and over the rows of pockets filled with eggs to provide a substantially uninterrupted flat upper cover surface for displaying advertising information and/or content information. The two cover sections are locked in the closed position by male locking projections which positively engage female locking ledges provided by apertures in the bottom section between the rows of egg pockets. A series of window openings are provided on each side of the carton for viewing the contents of all the egg pockets without opening the carton. The single positive locking projection on each cover section is offset from the longitudinal center of the carton, but the windows periodically interrupt the hinged connections between the bottom section and the cover sections to reduce the natural tendency of the cover sections to be urged out of their closed positions, thus insuring that the upper cover surface for displaying advertising and content information is maintained flat and substantially uninterrupted.

7 Claims, 6 Drawing Figures

WINDOWED MID-LOCK CARTON WITH POSITIVE CLOSURE LATCH

BACKGROUND OF THE INVENTION

The claimed invention relates to the field of articles molded to final shape from materials such as wood and paper pulp, plastics such as thermoplastics, and the like, for the packaging, shipping and retail merchandizing of fragile articles such as eggs, and more particularly to the style of molded egg carton having a pocketed bottom section and a pair of opposed inwardly foldable trough-shaped cover sections.

Prior to the present invention, it was known for many years to provide egg cartons made of cardboard or similar sheet material which had a pair of opposed inwardly foldable flat cover sections latchable by tuck-in tabs or other means to the pocketed bottom section in the closed position. Buttery U.S. Pat. No. 2,382,202 issued Aug. 14, 1945 discloses a collapsible carton of this nature, but a principal drawback to such cardboard cartons is the requirement that they must be "set up" — including a folding operation and a tab insertion, gluing or similar operation — after receipt from the carton manufacturer and before they are ready for packaging eggs.

The development of molded egg cartons eliminated the necessity of setting up the cartons at the point of egg packaging. Originally molded of paper and wood pulp materials, and now molded from thermoplastic materials as well as pulp, molded cartons can be nested one within the other in the empty condition in compact, rugged stacks for safe and inexpensive bulk shipment from the carton manufacturer to the egg packager. When unstacked, filled with eggs, and the covers closed by the egg packager, molded cartons provide an attractive, sturdy and inexpensive package for the shipment and retail merchandizing of eggs. Many different styles and arrangements of closable covers and locking mechanisms have been proposed for and used on molded egg cartons, some of which have proved to be commercially successful and some of which have not.

The present invention relates to the type of molded cartons — as opposed to cartons cut from flat sheet stock — wherein the closable cover takes the form of a pair of mirror image cover sections which are originally molded in an outward open position hingedly connected to the pocketed bottom section for folding thereover to a closed position. Numerous variations of this type of cover for molded egg carton have been proposed, and a continuing problem has been to insure that the cover sections are securely latchable in the closed position while at the same time providing a substantially uninterrupted flat upper cover surface to display advertising information and/or content information.

A survey of representative prior disclosures confirms that skilled designers of molded carton and other products have worked for many years to fill the long felt want for a carton which would meet these objectives. For instance, Chaplin U.S. Pat. No. 2,423,756 issued July 8, 1947 discloses tabs for holding one cover section against the other in the closed position (not locking the cover sections to the bottom section). Schwertfeger U.S. Pat. No. 2,591,471 issued Apr. 1, 1952 discloses detents (not projections) for latching the cover sections to the bottom section in the closed position. Vahle U.S. Pat. No. 2,933,227 issued Apr. 19, 1960 discloses cover sections molded so that the base or top walls join the walls which become the central walls in the closed position at an angle of about 90° (without positive latching means). Comstock U.S. Pat. No. 3,191,844 issued June 29, 1965 discloses a manner of molding trough-shaped cover sections so that in the closed position their base or top walls form a plane smooth top free from indentations for various printing designs (without positive latching means). Trimble U.S. Pat. No. 3,307,765 issued Mar. 7, 1967 discloses troughshaped cover sections molded so that the base or top walls join the central or mid-walls at an angle of about 90° (without positive latching means). Newman U.S. Pat. No. 3,568,915 issued Mar. 9, 1971 discloses a male element which protrudes outwardly from the mid-wall of one trough-shaped cover section and an aperture through the mid-wall of the other trough-shaped cover section to latch them together in the closed position (not locking the cover sections to the bottom section). French U.S. Pat. No. 3,580,480 issued May 25, 1971 discloses projections on the mid-wall of each cover section directed away from the centerline of the carton for latching the cover sections to the bottom section in the closed position.

The molded cartons disclosed in the aforesaid patents all seek to provide a substantially uninterrupted flat upper cover surface, which requires that the mid-walls of the cover sections are vertically against each other in the closed condition without a longitudinal crevice along the center of the carton top. This requirement militates against the use of locking mechanisms on the mid-walls which project toward each other when the cover sections are in the closed position. For this reason it has heretofore been the dogma of the art that hook or beak type male locking projections — such as those for use with nonanalogous types of covers disclosed for example in Friday U.S. Pat. No. 2,873,057 issued Feb. 10, 1959, and Hartmann U.S. Pat. No. 3,276,656 issued Oct. 4, 1966 — would not be applicable to the mid-lock style of cover arrangement for molded egg cartons.

By the same token, the concept of exterior windows for viewing the contents of the egg pockets is previously known, for instance, from Reifers U.S. Pat. No. 3,388,852 issued June 18, 1968, and Crabtree U.S. Pat. No. 3,647,132 issued Mar. 7, 1972. Such windows have not heretofore been utilized, however, for the supplemental purpose of controlling the inherent resilience characteristics of the cover section hinges to cooperate with positive locking mechanism in a manner which insures that the cover sections in the closed position provide a substantially uninterrupted flat upper cover surface.

Thus, the problem which has been long recognized as documented above, but heretofore unsolved is the provision of a molded egg carton having opposed cover sections which fold together and are positively latched to the bottom section in the closed position, yet are easily unlatchable, in a simplified manner which provides a substantially uninterrupted flat upper cover surface.

SUMMARY OF THE INVENTION

This invention solves the foregoing problems and provides a molded egg carton comprising a bottom section having two rows of downwardly dished egg pockets, a pair of cover sections hingedly connected to the sides of the bottom section for rotation between the as-molded open positions and closed positions overlying the rows of pockets, the empty carton being nestable with other like empty cartons in a stack for shipment and storage, the cover sections in the closed position providing a substantially uninterrupted flat upper cover surface, and means for locking each cover section directly to the bottom section which includes male locking projections which project first upwardly and then outwardly when the cover sections are in the open position (and which thus project first downwardly and then inwardly when the cover sections are in the closed position) for engagement with female locking ledges on the bottom section between the rows of pockets. The hinged connections comprise a series of aligned hinged portions spaced longitudinally apart by window openings which reduce the natural tendency of the hinged connections to urge the cover sections out of the closed position and back toward the as-molded open position.

BRIEF DESCRIPTION OF THE DRAWINGS

Numerous advantages of the present invention will become apparent to one skilled in the art from a reading of the detailed description in conjunction with the accompanying drawings, wherein similar reference characters refer to similar parts, and in which.

DETAILED DESCRIPTION

Figure 1:
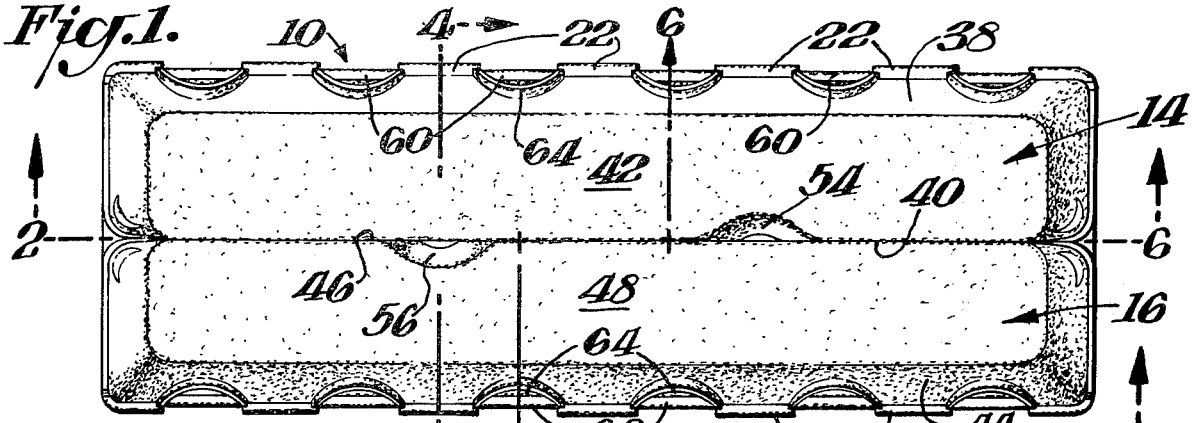
FIG. 1 is a top plan view of a molded egg carton according to this invention with the cover sections in the closed position.
Figure 2:
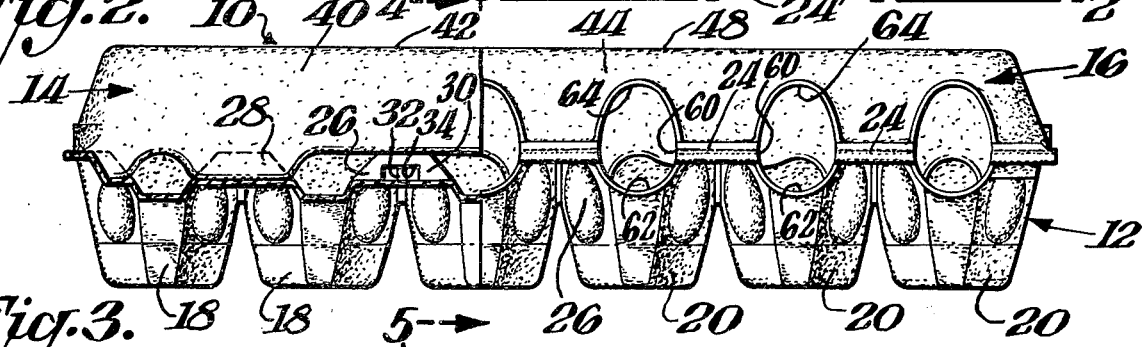
FIG. 2 is a side elevational view, partly in longitudinal sectional elevation on line 2—2 of FIG. 1.
Figure 3:
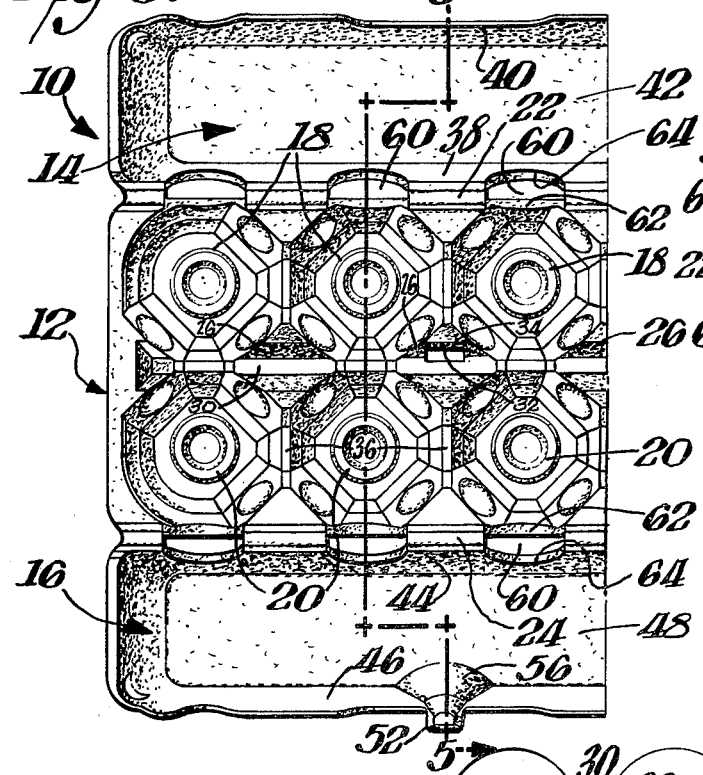
FIG. 3 is a partial top plan view with the cover sections in the open position.

The presently preferred embodiment of the present invention illustrated in the drawings is a one-piece egg carton 10 integrally molded to comprise a tray-like bottom section 12, a first cover section 14, and a second cover section 16. The bottom section 12 has a first row of egg pockets 18 downwardly dished from the upper margin thereof, and a parallel second row of downwardly dished egg pockets 20. The first cover section 14 is hingedly connected as at 22 to the upper margin along one side of the bottom section for rotation between an open as-molded position, and a closed position overlying the first row of pockets 18. The second cover section 16 is similarly hingedly connected as at 24 to the other side of the bottom section for rotation in the opposite direction between an open as-molded position, and a closed position overlying the second row of egg pockets 20.

In the illustrated embodiment, there are six egg pockets 18 in the first row, and six egg pockets 20 in the second row, forming what is known as a 2×6 carton for holding one dozen eggs. The principles of the present invention explained in more detail below are not confined, however to 2×6 egg cartons. On the contrary, the inventive contribution is useful in connection with cartons for packaging objects other than eggs, and the reference to egg cartons throughout this description and the appended claims should in no way be construed as limiting the invention in this regard. By the same token, the present invention is useful in molded cartons with pockets for eggs or equivalent articles arranged in configurations other than two rows having six pockets each. For instance, if three parallel rows of pockets are provided, then one cover section in the closed position overlies one row, and the other cover section in the closed position overlies the second and third rows. Similarly, the invention is equally useful with cartons having two rows of pockets with other than six pockets in each row — such as five pockets in each row to provide the so-called 2×5 arrangement popular in Europe for holding ten eggs.

The one-piece egg carton 10 may be molded directly to final shape from a pulp slurry against open-faced screen-covered molding dies after the well-known fashion. Equally useful are cartons molded from thermoplastic or other such materials. This invention is useful with any flexible materials and methods which form molded cartons which, when empty, are capable of being nested with other like empty cartons in a stack.

The bottom section 12 includes five upwardly tapering posts 26 spaced along the longitudinal centerline of the carton between the first and second rows of egg pockets 18, 20. Each post 26 has a top 28 which lies in the plane of the upper margin of the tray-like bottom section 12. The top 28 of each post 26, in the illustrated embodiment, may further include a valley 30 formed in the top in alignment with the longitudinal centerline of the carton. Each such valley is somewhat V-shaped in cross-section, having a narrow horizontal bottom wall, and two upwardly and outwardly sloping side walls.

The second and fourth posts 26 further include female locking ledges 32 formed by one edge of an aperture 34 through the tops of these two posts. In the preferred embodiment, the apertures 34 are partly through the horizontal base and partly through one side wall of the valleys 30, and the female locking ledges 32 are formed by the upper edge of the apertures 34 in the side walls of the valleys 30. The female locking ledge 32 formed in the top of the post 26 located between the second and third pockets 18 from the right-hand end of the first row of egg pockets 18 is formed in the valley side wall which faces that row of egg pockets, and is engageable with a male locking projection of the first cover section 14 which overlies the first row of pockets 18 in the closed position. The female locking ledge 32 formed in the top of the post 26 located between the second and third pockets 20 from the other or left-hand end of the second row of egg pockets 20 is formed in the valley side wall which faces that row of egg pockets, and is engageable with a male locking projection of the second cover section 16 which overlies the second row of pockets 20 in the closed position.

The posts 26 are connected to each other, and to the tray side walls of the bottom section 12, by rib constructions 36, the ribs in cross-section having an inverted V- or U-shaped configuration, after the well-known fashion. The ribs 36 serve to strengthen the carton, and in conjunction with the posts 26 to define the downwardly dished egg pockets 18, 20.

Figure 4:
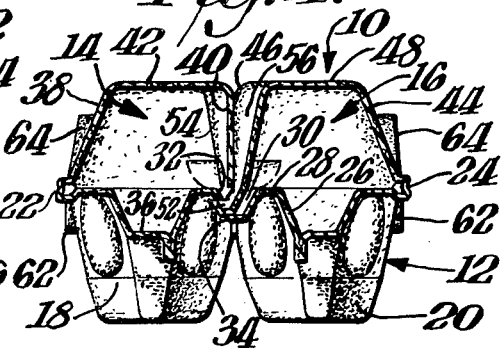
FIG. 4 is a transverse sectional elevational view on line 4—4 of FIG. 1 (closed covers)
Figure 6:
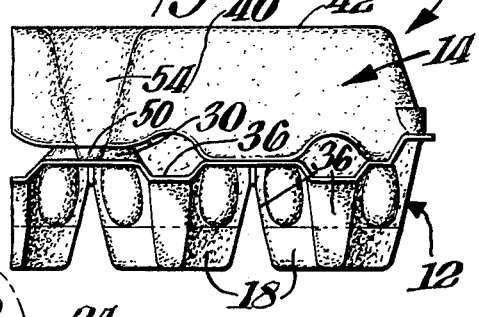
Figure 5:
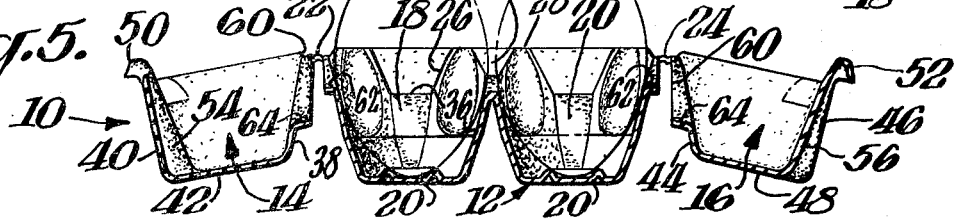
FIG. 5 is a transverse sectional elevational view on line 5—5 of FIG. 3 (open covers); and, FIG. 6 is a partial longitudinal sectional elevational view on line 6—6 of FIG. 1.

The carton cover sections 14, 16 are trough-shaped, being right-side-up in the open position and up-side-down in the closed position. The first cover section 14 includes a first side wall 38 one edge of which is hingedly connected as at 22 to the bottom section, a second side wall 40 or mid-wall which contains a male locking projection described below, and a base or top wall 42 connecting between the first 38 and second 40 side walls. The second cover section 16 includes a first side wall 44 one edge of which is hingedly connected as at 24 to the bottom section, a second side wall 46 or mid-wall which contains a male locking projection described below, and a base or top wall 48 connecting between the first 44 and second 46 side walls. The connection between the base or top walls 42, 48 and the second side walls 40, 46 or mid-walls, respectively, is at an angle of about 90°. When the cover sections 14, 16 are in the full open as-molded position, as illustrated in FIG. 5, the midwalls 40, 46 are at a sloping angle from the vertical, which permits the cartons to be removed from the dies on which they are molded, and also permits the carton 10 to be nested with other like empty cartons in a stack for shipment and storage. When the cover sections 14, 16 are in the closed position, as illustrated in FIGS. 1 and 4, the 90° angle permits the mid-walls 40, 46 to be vertically against each other, and the base or top walls 40, 48 to provide a substantially uninterrupted, flat, upper horizontal cover surface ideally adapted for the display of advertising information and/or content information — without a deep longitudinal crevice along the top of the carton between the closed cover sections.

A principal feature of the present invention is the provision of means for positively latching or locking the cover sections directly to the bottom section in the closed position. This is characterized by hook or "beak" type male locking projections on each cover section. The male locking projection 50 on the first cover section 14, and the male locking projection 52 on the second cover section 16, each project first upwardly and then outwardly when the cover sections are in the open position, and project first downwardly and then inwardly when the cover sections are in the closed position. The male locking projections 50, 52 engage with the female locking ledges 34 on the bottom section 12 between the first and second rows of egg pockets 18, 20 to positively latch the cover sections 14, 16 directly to the bottom section 12.

The locking projection 50 on the first cover section 14 is formed at the terminus of a recessed rib 54 which extends across the flexible second side wall 40. The locking projection 52 on the second cover section 16 is formed at the terminus of a recessed rib 56 which extends across the flexible second side wall 46. The other (or upper in the closed position) terminus of the recessed ribs 54, 56 provide spaces, or small fingertip openings, in the flat upper cover surface provided by the top walls 42, 58. The spaces provided by the recessed ribs are small enough that they do not substantially interrupt the expanse of the upper cover surface, but they permit manual access, such as with a thumb or finger, to flex the mid-walls 40, 46 in the areas of the lower ends of the recessed ribs 54, 56 to easily disengage the male locking projections 50, 52 from the female locking ledges 32 for opening the carton.

As can easily be visualized from FIG. 1, if the carton 10 is approached from the right-hand end and grasped by and held in the right-hand, the open space 54 invites insertion of the thumb of the right-hand for the application of a small amount of squeezing pressure to disengage the locking projection 50 from its locking ledge 32 and permit rolling open of the first cover section 14 about its hinge line 22. By the same token, when the carton is held in this position, the left-hand naturally gravitates toward the other side of the carton, and the open space 56 invites insertion of the thumb of the left-hand for similarly opening the second cover section 16.

AS should be clear from an inspection of the drawings, the locking projection 50 of the first cover section 14 is engageable with a female locking ledge 32 formed in the top of a post 26 located between the second and third pockets from the right-hand end of the first row of egg pockets 18, and the locking projection 52 of the second cover section 16 is engageable with a female locking ledge 32 formed in the top of a post 26 located between the second and third pockets from the other or left-hand end of the second row of egg pockets 20. Other arrangements, however, are equally applicable, such as positioning the locking means between the first and second pockets from each end of the respective rows of egg pockets. When utilizing the locking means of this invention with a 2×5 carton, rather than the illustrated 2×6 carton, the locking means will be provided in the second and third posts, rather than the second and fourth posts as in the illustrated embodiment. For the style of 2×6 cartons which are provided with central lateral score lines therearound or other means to permit the carton to be separated into two independent 2×3 cartons, then two locking projections are provided for each cover section, one at one end and the other at the other end of the carton, as can easily be understood.

When closing the carton, the locking projections flex the mid-walls apart slightly until each projection is in its aperture 34 and positively latched beneath its female locking ledge 32, after which the inherent resiliancy of the mid-walls returns them to their fully closed position vertically against each other. In this position, the free lower edges of the mid-walls rest on the bases of the valleys 30 to resist vertical forces applied to the carton. The notched valleys 30 further serve to insure that the mid-walls are in their desired vertical position with the locking projections positively engaged beneath their locking ledges.

The hinged connections 22, 24 between the bottom section 12 and the cover sections 14, 16, respectively, each comprise a series of integrally molded aligned hinge portions parallel with the first and second rows of egg pockets 18, 20. The series of hinge portions are spaced longitudinally apart by openings 60 which reduce the natural tendency of the hinged connections to urge the cover sections out of the closed position (FIG. 4) and back toward the open position (FIG. 5).

The openings 60 preferably are located adjacent the egg pockets, and each opening may extend downwardly as at 62 for a portion of the depth of the downwardly dished egg pocket to provide a window for visually inspecting the contents of the egg pocket, for instance to check for a full count of eggs and whether they are white or brown. The window openings 60 optionally may also extend into a portion of the first walls of the cover sections, as at 64, to vertically elongate the windows in an upward direction for better viewing the contents of the egg pockets. In the illustrated embodiment, the windows 60 when viewed from the side of the carton are ovoid in shape, with the long axis vertical and the upper portion 64 extending upwardly from the hinge line a greater distance than the lower portion 62 extends downwardly from the hinge line, however other window shapes and sizes are equally applicable. In the preferred embodiment, a window 60 is located adjacent each egg pocket in each row of pockets to provide a view of the contents of every pocket in the two rows, but this is not considered to be an essential requirement of the invention.

The locking means and the window-interrupted hinges according to this invention cooperate to insure a simplified positive latch arrangement combined with a substantially uninterrupted flat upper carton surface. By providing only one locking projection for each cover section, disengaging the lock and opening the cover section can be accomplished as an essentially one-handed operation, which tremendously simplifies use of the carton. To prevent interference of the locking projections with each other, they are off-set so that the locking projection of one cover section is nearer one end of the carton, while the locking projection of the other cover section is nearer the other end of the carton. The well-known normal tendency of integrally molded hinges is to rotate the cover sections away from the folded closed position and back toward the original asmolded open position. The tendency of each cover section to be warped upwardly from the fully closed position, particularly at the end remote from the off-set locking projection, however, is minimized by the openings which interrupt the hinges and weaken their natural tendency to curl the corners of the cover sections upwardly in a manner which would defeat the flat upper cover surface concept.

Reference to the disclosures of the above-identified patents is recommended for a more complete understanding of the scope and content of the prior art, and of the merits of the present invention and how it differs from the prior art.

While the above described embodiment constitutes the presently preferred mode of practicing this invention, other embodiments and equivalents are fairly included within the scope of the basic inventive concept, which is claimed as:

1. A molded carton for packaging articles such as eggs comprising a bottom section having a first row and a second row of downwardly dished article receiving pockets with upwardly tapering posts between the rows of pockets, a first cover section hingedly connected to one side of the bottom section for rotation between an open position and a closed position overlying the first row of pockets, a second cover section hingedly connected to the other side of the bottom section for rotation between an open position and a closed position overlying the second row of pockets, the first and second cover sections being dimensioned so that when they are in the open position the empty carton can be nested with other like empty cartons in a stack for shipment and storage, and so that when they are in the closed position overlying the first and second rows of pockets they provide a substantially uninterrupted flat upper cover surface adapted for the display of advertising and content information, and means for locking the cover sections to the bottom section in the closed position characterized by a male locking projection on each cover section which project upwardly and outwardly when the cover sections are in the open position and which project downwardly and inwardly when the cover sections are in the closed position for engagement with female locking ledges formed by the upper edges of apertures located partly through the base and partly through one side of a valley formed in the tops of the posts in parallel alignment with the rows of pockets.

2. A molded carton for packaging articles such as eggs comprising a bottom section having a first row and a second row of downwardly dished article receiving pockets with upwardly tapering posts between the rows of pockets, a first cover section hingedly connected to one side of the bottom section for rotation between an open position and a closed position overlying the first row of pockets, a second cover section hingedly connected to the other side of the bottom section for rotation between an open position and a closed position overlying the second row of pockets, the hinged connections between the bottom section and the cover sections each comprising a series of aligned hinge portions parallel with the first and second rows of pockets, the hinge portions being spaced longitudinally apart by openings which reduce the natural tendency of the hinged connections to urge the cover sections out of the closed position and back toward the open position, the first and second cover sections being dimensioned so that when they are in the open position the empty carton can be nested with other like empty cartons in a stack for shipment and storage, and so that when they are in the closed position overlying the first and second rows of pockets they provide a substantially uninterrupted flat upper cover surface adapted for the display of advertising and content information, means for locking the cover sections to the bottom section in the closed position including a male locking projection on each cover section which project upwardly and outwardly when the cover sections are in the open position and which project downwardly and inwardly when the cover sections are in the closed position for engagement with female locking ledges formed by one edge of an aperture through the top of a post, the openings between the spaced hinge portions being characterized in that they are located adjacent pockets, and each opening extends downwardly for a portion of the depth of the downwardly dished pocket to provide a window for viewing the contents of the pocket.

3. A molded carton as in claim 2 wherein the first and second cover sections are trough-shaped and each includes a first side wall one edge of which is hingedly connected to the bottom section, a second side wall containing the male locking projections, and a base wall connecting between the first and second side walls, the connection between the base walls and the second side walls being at an angle of about 90° whereby in the closed position the second side walls are vertically against each other and the base walls provide the substantially uninterrupted flat upper cover surface.

4. A molded carton as in claim 3 wherein the openings between the spaced hinge portions each also extend into a portion of the first side wall of the cover sections to vertically elongate the windows for better viewing the contents of the pockets.

5. A molded carton as in claim 4 wherein a window is located adjacent each pocket in the first and second rows of pockets to provide a view of the contents of every pocket in the rows.

6. A molded carton as in claim 3 wherein the male locking projections on the second side walls of the cover sections are formed at the terminus of recessed ribs extending across the second side walls, the other terminus of the recessed ribs providing spaces in the flat upper cover surface for manual access to flex the second side walls in the areas of the recessed ribs to disengage the male locking projections from the female locking ledges for opening the carton.

7. A molded carton as in claim 6 wherein the second side wall of each cover section contains one male locking projection, the projection of the first cover section being engageable with a female locking ledge formed in the top of a post located between the second and third pockets from one end of the first row of pockets, and the projection of the second cover section being engageable with a female locking ledge formed in the top of a post located between the second and third pockets from the other end of the second row of pockets.

* * * * *